US007029141B1

(12) United States Patent
Skelly et al.

(10) Patent No.: US 7,029,141 B1
(45) Date of Patent: Apr. 18, 2006

(54) LIGHTED BOW SITE DEVICE

(76) Inventors: Robert J. Skelly, P.O. Box 134, Wilmore, PA (US) 15962; Michael E. Skelly, P.O. Box 134, Wilmore, PA (US) 15962

( * ) Notice: Subject to any disclaimer, the term of this patent is extended or adjusted under 35 U.S.C. 154(b) by 15 days.

(21) Appl. No.: 10/800,282

(22) Filed: Mar. 15, 2004

(51) Int. Cl.
*F41G 1/34* (2006.01)

(52) U.S. Cl. ..... 362/109; 33/265; 33/241

(58) Field of Classification Search ..... 362/109, 362/110, 554, 433, 368, 370, 371, 382
See application file for complete search history.

(56) References Cited

U.S. PATENT DOCUMENTS 4,400,887 A 8/1983 Mason
4,813,150 A 3/1989 Colvin
4,928,394 A 5/1990 Sherman
5,435,068 A 7/1995 Thames et al.
5,560,113 A * 10/1996 Simo et al. ..... 33/265
5,720,270 A * 2/1998 Meicke ..... 124/87
6,073,352 A 6/2000 Zykan et al.
6,397,483 B1 * 6/2002 Perkins ..... 33/265
2002/0083602 A1 7/2002 States

* cited by examiner

*Primary Examiner*—Renee Luebke
*Assistant Examiner*—Evan Dzierzynski

(57) ABSTRACT

A lighted bow sight device includes a loop member that defines a sight window. The loop member includes a fist side wall, a second side wall, a top wall, and a bottom wall. The first side wall has an inner surface facing the second side wall. A mounting assembly removably attaches the loop member to a bow. Each of a plurality of elongated containers is attached to and extends away from the inner surface of the first side wall and toward the second side wall. Each of the containers defines a sight pin. Each of the containers comprises a substantially transparent material. A light source is mounted in the loop member. A plurality of fiber optic cables is in connection with the light source such that each of the fiber optic cables is illuminated when the light source is turned on.

6 Claims, 4 Drawing Sheets

LIGHTED BOW SITE DEVICE

BACKGROUND OF THE INVENTION

1. Field of the Invention

The present invention relates to bow sight devices and more particularly pertains to a new bow sight device for providing illuminated sights for use during time of low light levels.

2. Description of the Prior Art

The use of bow sight devices is known in the prior art. While these devices fulfill their respective, particular objectives and requirements, the need remains for a device that allows for moveable sights that includes a bow mounted actuator for turning the sights on or off without significant movement by the user of the bow.

SUMMARY OF THE INVENTION

The present invention meets the needs presented above by generally comprising a loop member defining a sight window. The loop member includes a fist side wall, a second side wall, a top wall, and a bottom wall. The first side wall has an inner surface facing the second side wall and an outer surface facing away from the inner surface. A mounting assembly is adapted for removably attaching the loop member to a bow. Each of a plurality of elongated containers is attached to and extends away from the inner surface of the first side wall and toward the second side wall. Each of the containers defines a sight pin. Each of the containers comprises a substantially transparent material. A light source is mounted in the loop member. A plurality of fiber optic cables is in connection with the light source such that each of the fiber optic cables is illuminated when the light source is turned on.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
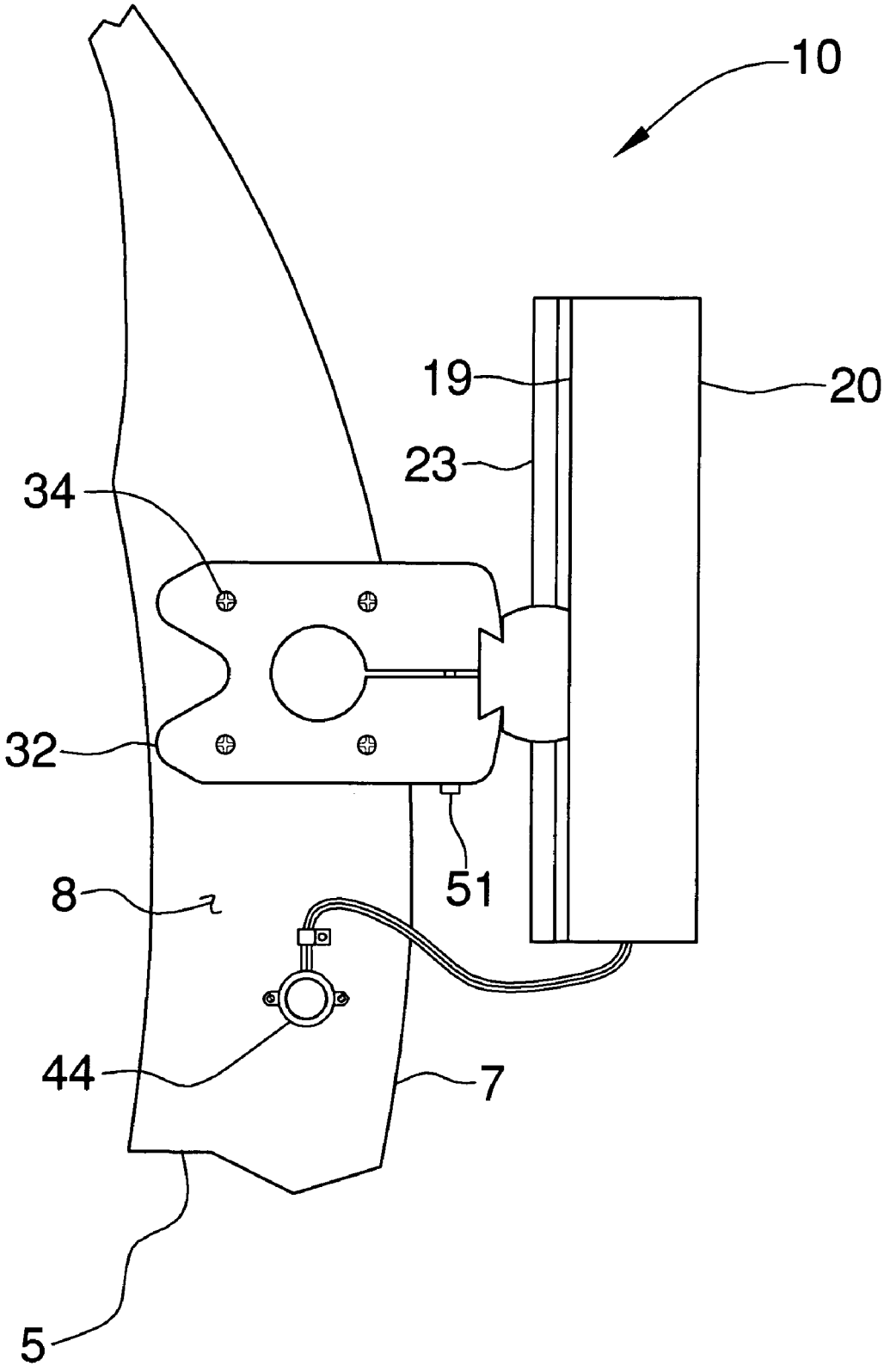
FIG. 1 is a side view of a lighted bow sight device according the present invention.
Figure 2:
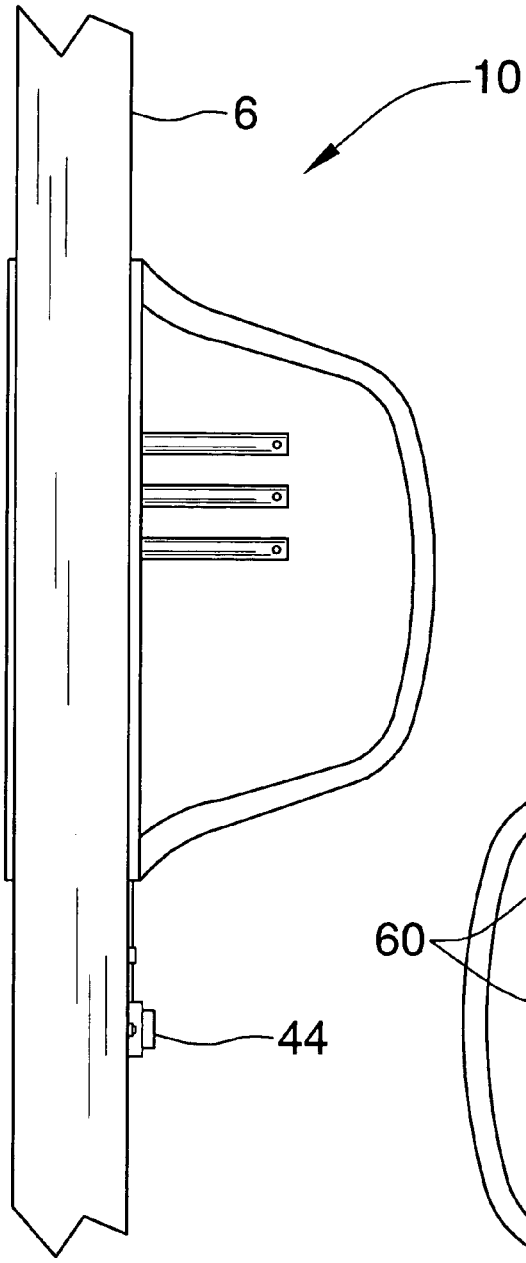
FIG. 2 is a front view of the present invention.
Figure 3:
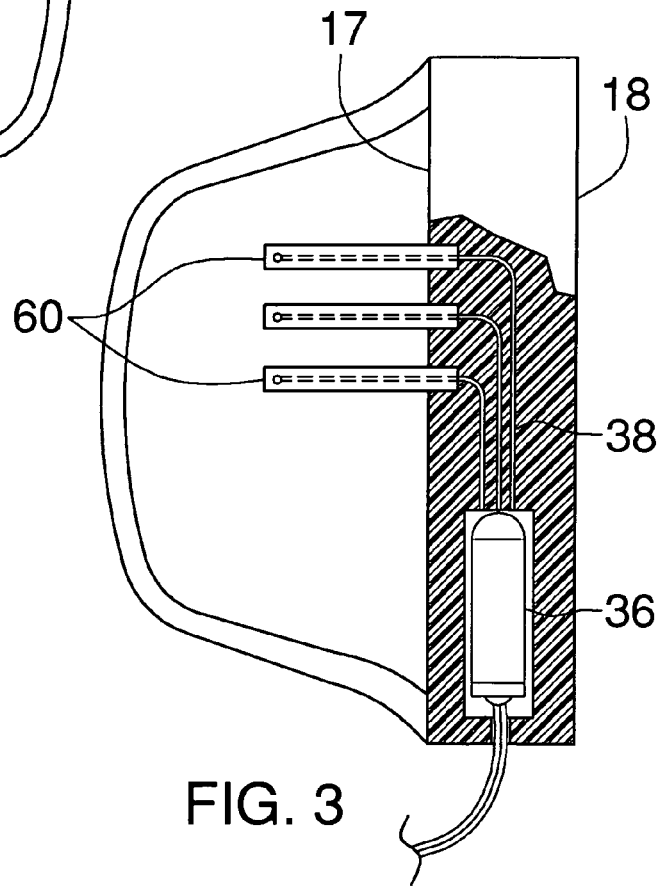
FIG. 3 is a back view of the present invention.
Figure 4:
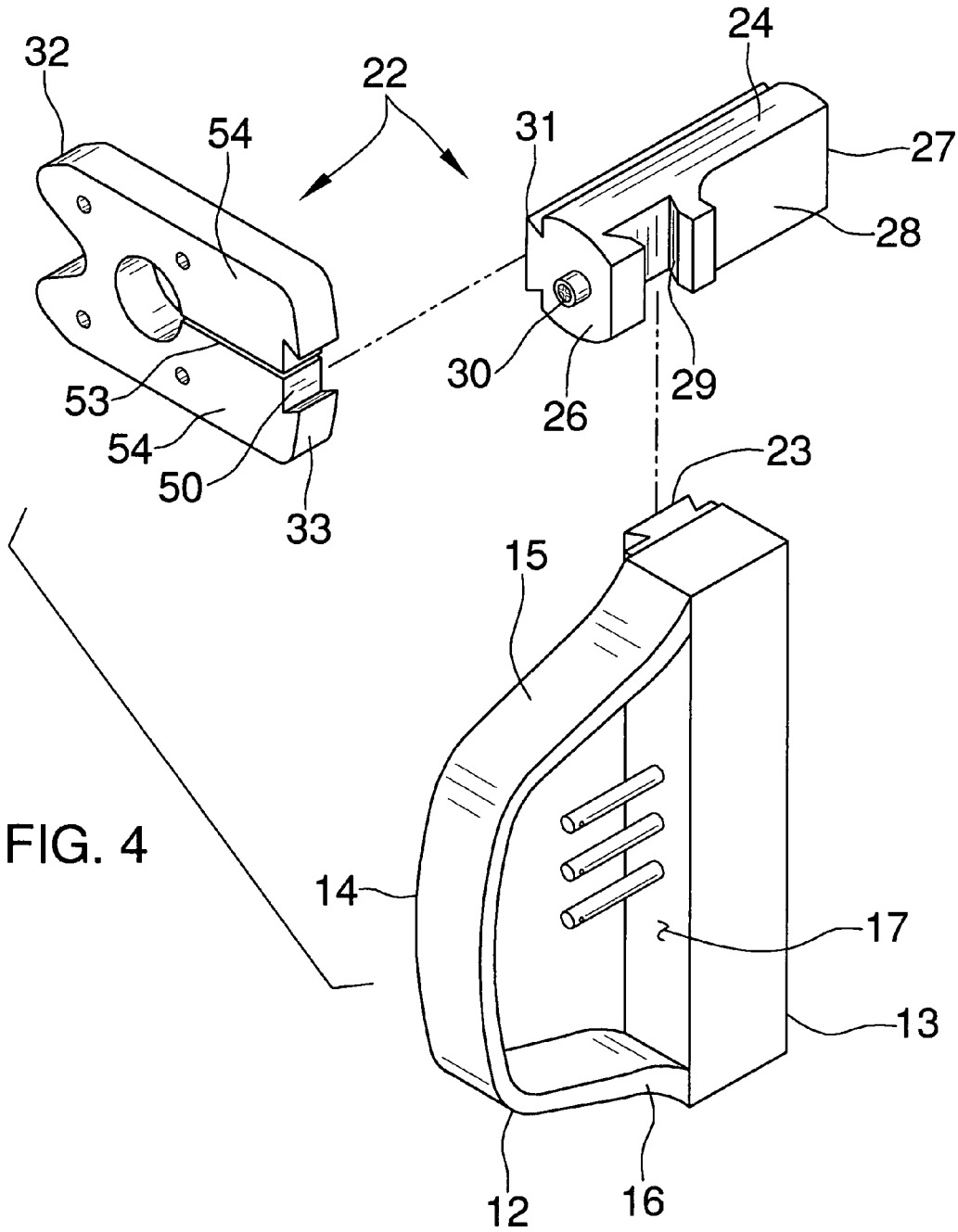
FIG. 4 is a schematic perspective view of the mounting assembly of the present invention.
Figure 5:
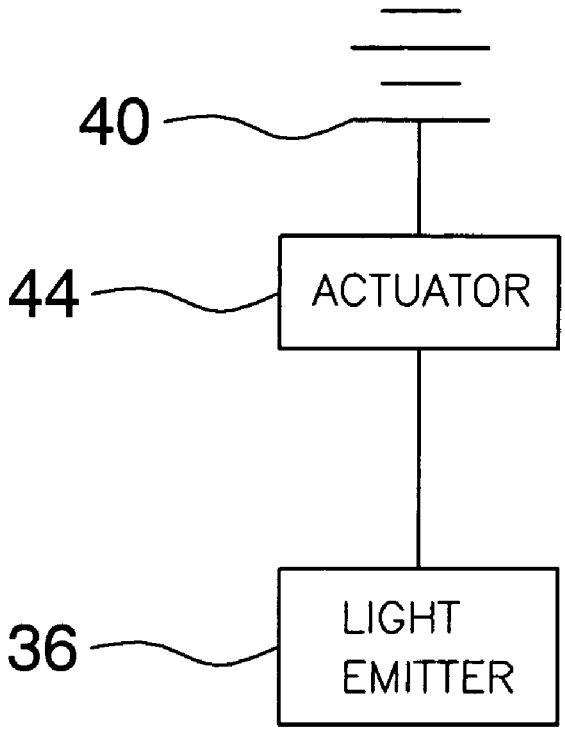
FIG. 5 is an electrical schematic view of the present invention.

With reference now to the drawings, and in particular to FIGS. 1 through 5 thereof, a new bow sight device embodying the principles and concepts of the present invention and generally designated by the reference numeral 10 will be described.

As best illustrated in FIGS. 1 through 5, the lighted bow sight device 10 generally comprises an assembly that is adapted for being positioned on a bow 5 adjacent to a handle of the bow 5. The assembly includes a loop member 12 that defines a sight window. The loop member 12 includes a fist side wall 13, a second side wall 14, a top wall 15, and a bottom wall 16. The first side wall 13 has an inner surface 17 facing the second side wall 14 and an outer surface 18 facing away from the inner surface 17. The first side wall 13 also has a front side 19 and a back side 20. The second side wall 14 is arcuate and is bowed outwardly away from the first side wall 13.

A mounting assembly 22 is adapted for removably attaching the loop member 12 to the bow 6 such that the front side 19 of the first side wall 13 is adjacent to and aligned with a forward side 7 of the bow 6. This orientation causes the loop member 12 to extend laterally with respect to the bow 6 so that it is positioned within the sight of a person using the bow 6.

The mounting assembly 22 includes a first ridge 23 that is attached to and extends along a length of the front side 19 of the first side wall 13. An elongated member 24 has a first end 26, a second end 27 and a peripheral wall 28 extending between the first 26 and second 27 ends. The peripheral wall 28 has a first channel 29 therein positioned adjacent to the first end 26 of the elongated member 24. The first channel 29 may selectively receive the first ridge 23 and may be selectively positioned along a length of the first ridge 23. A fastener 30 is selectively extendable into the first channel 29 for releasably locking the first ridge 23 in the first channel 29. The fastener 30 is preferably a threaded rod or other similar fastener. A second ridge 31 is attached to and extends between the first 26 and second 27 ends of the peripheral wall 28 of the elongated member 24. The second ridge 31 is positioned opposite of the first channel. A bracket 32 is adapted for being removably coupled to a lateral side wall 8 of the bow 6 such that the bracket 32 has a free end 33 extending forward of the bow 6. The bracket 32 may be attached to the bow 6 with conventional screws 34 or other fasteners. The free end 33 has a second channel 50 positioned therein. The second channel 50 may selectively receive the second ridge 31 and may be selectively positioned along a length of the second ridge 31. A coupler 51 is selectively extendable into the bracket 32 for releasably locking the second ridge 31 in the second channel 50. The bracket 32 may include a slit 53 extending through the second channel 50 and into the bracket 32 so that a pair of arms 54 is defined. The coupler 51, which preferably includes a screw or bolt, pulls the arms 54 together to shorten the width of the second channel 50 in order to grip the second ridge 31. It is preferred that the ridges 23, 31 have outwardly extending side walls and the channels 29, 50 have matching inwardly extending side walls to aid in the stability of the mounting assembly 22.

The mounting assembly 22 construction serves the purpose of allowing the user of the bow 6 to move the loop member 12 horizontally or vertically with respect to the bow 6. Because of this, the bracket 32 need not be perfectly positioned on the bow for the user of the bow 6, and the loop member may be readjusted for different users of the same bow 6.

Each of a plurality of elongated containers 60 is attached to and extends away from the inner surface 17 of the first side wall 13 and toward the second side wall 14. Each of the containers 60 defines a sight pin and each of the containers 60 comprises a substantially transparent material. The plurality of containers 60 is preferably at least 3 containers. A conventional light source 36 is mounted in the loop member. A plurality of fiber optic cables 38 is in connection with the light source 36 such that each of the fiber optic cables 38 is illuminated when the light source 36 is turned on. Each of the fiber optic cables 38 extends into one of the containers. An actuator 44 is operationally coupled to the light source 36 for selectively turning the light source 36 on or off. The actuator 44 is selectively mounted to the bow 6 adjacent to the mounting assembly 32. A power supply 40 is electrically coupled to the light source 36. The power supply 40 is preferably mounted in the loop member 12.

In use the device 10 is mounted on the bow 5 and used as a conventional bow sight. The lighted nature of the bow sights allows their use in low light conditions where conventional sights would be difficult to see. The actuator 44 is mounted adjacent to the loop member 12 so that the user may turn the light source 36 on or off without an excessive amount of movement, and it is preferred that the actuator 44 is positioned so that the hand gripping the bow 6 covers the actuator 44. This saves on battery life and prevents disturbing nearby animals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lighted bow sight assembly for positioning on a bow adjacent to a handle of the bow, said assembly comprising:

a loop member defining a sight window, said loop member including a fist side wall, a second side wall, a top wall, and a bottom wall, said first side wall having an inner surface facing said second side wall and an outer surface facing away from said inner surface, said first side wall including a front side and a back side;

a mounting assembly being adapted for removably attaching the loop member to the bow, said mounting assembly including;

a first ridge being attached to an extending along a length of said front side of said first side wall;

an elongated member having a first end, a second end and a peripheral wall extending between said first and second ends, said peripheral wall having a first channel therein positioned adjacent to said first end of said elongated member, wherein said first channel may selectively receive and first ridge and may be selectively positioned along a length of said first ridge;

a second ridge being attached to and extending between said first and second ends of said peripheral wall of said elongated member, said second ridge being positioned opposite of said first channel;

a bracket adapted for being removably coupled to a lateral side wall of the bow such that said bracket has a free end extending forward of the bow, said free end having a second channel positioned therein, wherein said second channel may selectively receive said second ridge and may be selectively positioned along a length of said second ridge, a plurality of elongated containers, each of said containers being attached to and extending away from said inner surface of said first side wall and toward said second side wall, each of said containers defining a sight pin, each of said containers comprising a substantially transparent material;

a light source being mounted in said loop member;

a plurality of fiber optic cables being connection with said light source such that each of said fiber optic cables is illuminated when said light source is turned on.

2. The assembly according to claim 1, further including a fastener being selectively extendable into said first channel for releasably locking said first ridge in said first channel.

3. The assembly according to claim 2, a coupler being selectively extendable into said bracket for releasably locking said second channel.

4. The assembly according to claim 1, a coupler being selectively extendable into said bracket for releasably locking said second ridge in said second channel.

5. The assembly according to claim 1, further including an actuator being operationally coupled to said light source for selectively turning said light source on or off, said actuator being selectively mounted to the bow adjacent to said mounting assembly.

6. A lighted bow sight assembly for positioning on a bow adjacent to a handle of the bow, said assembly comprising:

a loop member defining a sight window, said loop member including a first side wall, a second side wall, a top wall, and a bottom wall, said first side wall having an inner surface facing said second side wall and an outer surface facing away from said inner surface, said first side wall including a front side and a back side, said second side wall being arcuate and being bowed outwardly away from said first side wall;

a mounting assembly being adapted for removably attaching the loop member to the bow such that said front side of said first side wall is adjacent to and aligned with a forward side of the bow, said mounting assembly including;

a first ridge being attached to and extending along a length of said front side of said first side wall;

an elongated member having a first end, a second end and a peripheral wall extending between said first and second ends, said peripheral wall having a first channel therein positioned adjacent to said first end of said elongated member; wherein said first channel may selectively receive said first ridge and may be selectively positioned along a length of said first ridge;

a fastener being selectively extendable into said first channel for releasably locking said first ridge in said first channel;

a second ridge being attached to and extending between said first and second ends of said peripheral wall of said elongated member; said second ridge being positioned opposite of said first channel;

a bracket adapted for being removably coupled to a lateral side wall of the bow such that said bracket has a free end extending forward of the bow, said free end having a second channel positioned therein, wherein said second channel may selectively receive said second ridge and may be selectively positioned along a length of said second ridge;

a coupler being selectively extendable into said bracket for releasably locking said second ridge in said second channel;

a plurality of elongated containers, each of said containers being attached to and extending away from said inner surface of said first side wall and toward said second side wall, each of said containers defining a sight pin, each of said containers comprising a substantially transparent material;

a light source being mounted in said loop member;

a plurality of fiber optic cables being in connection with said light source such that each of said fiber optic cables is illuminated when said light source is turned on, each of said fiber optic cables extending into one of said containers; and an actuator being operationally coupled to said light source for selectively turning said light source on or off; said actuator being selectively mounted to the bow adjacent to said mounting assembly.

* * * * *